United States Patent [19]

Uhlig et al.

[11] 4,331,442

[45] May 25, 1982

[54] PROCESS FOR DYEING CELLULOSE TEXTILE MATERIALS BY THE PADDING PROCESS

[75] Inventors: Heinrich Uhlig, Leverkusen; Klaus Langheinrich, Berg.-Gladbach; Udo-Winfried Hendricks, Odenthal, all of Fed. Rep. of Germany

[73] Assignee: Bayer Aktiengesellschaft, Leverkusen, Fed. Rep. of Germany

[21] Appl. No.: 838,210

[22] Filed: Sep. 30, 1977

[30] Foreign Application Priority Data

Oct. 1, 1976 [DE] Fed. Rep. of Germany ..... 2644436

[51] Int. Cl.[3] ..... D06P 1/38; D06P 1/613

[52] U.S. Cl. ..... 8/564; 8/565; 8/572; 8/532

[58] Field of Search ..... 8/85 R, 85 B, 1 A, 54.2, 8/564, 565, 572

[56] References Cited

U.S. PATENT DOCUMENTS

| | | | |
|---|---|---|---|
| 3,963,418 | 6/1976 | Tullio | 8/85 B |
| 3,963,430 | 6/1976 | Nonn et al. | 8/85 B |
| 4,083,689 | 4/1978 | Wolf et al. | 8/564 |
| 4,179,267 | 12/1979 | Lacroix et al. | 8/564 |

FOREIGN PATENT DOCUMENTS

| | | | |
|---|---|---|---|
| 668961 | 3/1952 | United Kingdom | 8/85 R |
| 770460 | 3/1957 | United Kingdom | 8/85 R |
| 823062 | 11/1959 | United Kingdom | 8/85 R |
| 1060063 | 2/1967 | United Kingdom | 8/85 R |

OTHER PUBLICATIONS

Hall, A. J., The Standard Handbook of Textiles, John Wiley & Sons, N.Y., 19, p. 266.

Peters, R. H., Textile Chemistry, Elsevier, Scientific Publ. Co., N.Y., 1975, pp. 384, 385, 613.

Textile World, Jan. 1964, p. 71.

*Primary Examiner*—Maria Parrish Tungol

*Attorney, Agent, or Firm*—Sprung, Horn, Kramer & Woods

[57] ABSTRACT

Process for dyeing textile materials of cellulose, by means of direct dyestuffs or reactive dyestuffs, by padding with aqueous dyeing liquors which contain cyclic carboxylic acid amides of the formula

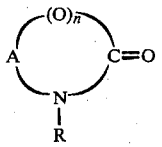

in which

R represents a hydrogen atom, a $C_1$–$C_4$-alkyl radical or a $C_1$–$C_4$-hydroxyalkyl radical and A represents an alkylene radical required to complete a five-membered to seven-membered ring system and optionally substituted by halogen, $C_1$–$C_4$-alkyl or $C_1$–$C_4$-hydroxyalkyl and n is 0 or 1, and, optionally, glycol compounds of the formula $$R'-O-CH_2-\underset{\underset{R''}{|}}{CH}-X-(CH_2-\underset{\underset{R''}{|}}{CH}-O)_n-R'''$$

in which

R′ and R‴ independently of one another represent hydrogen, a $C_1$–$C_5$-alkyl group or an acetyl group, R″ represents hydrogen or methyl, n represents a number from 0 to 2 and X represents an oxygen atom or a sulphur atom, and fixing of the dyestuffs.

15 Claims, No Drawings

PROCESS FOR DYEING CELLULOSE TEXTILE MATERIALS BY THE PADDING PROCESS

The subject of the invention is a process for dyeing textile materials which consist entirely or partially of natural or regenerated cellulose, by means of direct dyestuffs or reactive dyestuffs, using the cold dwell, pad-steam and thermofixing methods.

The process is characterised in that the cellulose textile materials are padded with aqueous dyeing liquors which, in addition to the direct dyestuffs or reactive dyestuffs, contain cyclic carboxylic acid amides of the formula

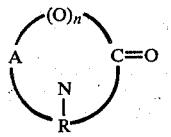

(I)

in which

R represents a hydrogen atom, a $C_1$–$C_4$-alkyl radical or a $C_1$–$C_4$-hydroxyalkyl radical and A represents an alkylene radical required to complete a five-membered to seven-membered ring system and optionally substituted by halogen, $C_1$–$C_4$-alkyl or $C_1$–$C_4$-hydroxyalkyl and n is 0 or 1, and, optionally, glycol compounds of the formula $$R'-O-CH_2-\underset{\underset{R''}{|}}{CH}-X-(CH_2-\underset{\underset{R''}{|}}{CH}-O)_n-R''' \quad (II)$$

in which

R′ and R‴ independently of one another represent hydrogen, a $C_1$–$C_5$-alkyl group or an acetyl group, R″ represents hydrogen or methyl, n represents a number from 0 to 2 and X represents an oxygen atom or a sulphur atom, and, in the case of the reactive dyestuffs, also compounds which have an alkaline reaction, and the fixing of the dyestuffs is subsequently carried out in the usual manner either by a dwell at room temperature or by the action of steam or by dry heat.

Compounds of the formula I, in which n represents 0,

A represents a straight-chain $C_3$–$C_5$-alkylene radical and

R represents hydrogen or methyl are preferred.

The following may be mentioned as examples of the cyclic carboxylic acid amides of the formula I to be used according to the invention: 2-pyrrolidone, N-methyl-2-pyrrolidone, N-hydroxyethyl-2-pyrrolidone, caprolactam, N-methyl-caprolactam, N-hydroxy-ethyl-caprolactam, 6-methyl-caprolactam, oxazolidone, N-(2-hydroxyethyl)-oxazolidone and 6-methyloxazolidone. Amongst the compounds mentioned, caprolactam is preferred.

Suitable glycol compounds of the formula II have proved to be glycol, diethylene glycol, triethylene glycol, bis-(2-hydroxyethyl)sulphide, glycol monomethyl ether, glycol monoethyl ether, glycol monobutyl ether, diethylene glycol monomethyl ether, diethylene glycol monoethyl ether and diethylene glycol monobutyl ether.

The amount in which the cyclic carboxylic acid amides of the formula I and, if present, glycol compounds of the formula II are employed in the dyeing liquors can vary within wide limits; depending on the depth of colour, amounts of 10–100 g, preferably 20–80 g, per liter of dyeing liquor have proved advantageous.

The process according to the invention is suitable for dyeing textile materials—especially woven fabrics and knitted fabrics—of regenerated cellulose, such as staple rayon or viscose, and especially natural cellulose, such as cotton or linen, in accordance with the cold dwell, pad-steam and thermofixing process.

In the sense of the invention, the cold dwell process is to be understood as a dyeing process in which the textile materials impregnated on a padder with a padding liquor described above are rolled up, and stored for between 18 and 24 hours at temperatures of 20°–30°, in order to fix the dyestuffs. In the pad-steam process, the textile materials padded with the dyestuff liquor are subjected to a treatment in a steamer, with steam which may be superheated, at temperatures of 102°–120° C., in order to effect the fixing, an intermediate drying of the fabric at about 100° C. being carried out optionally before the treatment in the steamer. In the case of the thermofixing process, the dyestuffs are fixed by heating for from 1 to 10 minutes, preferably from 1 to 3 minutes, to temperatures of 95°–200° C., preferably of 100°–150° C.

The dyestuffs employed in the process according to the invention are the direct dyestuffs and reactive dyestuffs usually employed for dyeing cellulose textile materials.

Examples of direct dyestuffs are described in the Colour Index, 3rd edition (1971), volume 2, pages 2,005 to 2,478, and examples of reactive dyestuffs are described in volume 3, pages 3,391–3,560.

It has in many cases proved advantageous to add to the dyeing liquors, over and above the cyclic carboxylic acid amides and glycol compounds, commercially available wetting agents, such as sulphosuccinic acid esters, for example sodium di-hexyl-sulphosuccinate, or glyercol-ether sulphates, for example dioctyl glycerol ether sulphate. In addition, the padding liquors may contain the conventional thickeners, for examples alginate thickeners.

Examples of compounds, having an alkaline reaction, which are employed for fixing the reactive dyestuffs are sodium carbonate, sodium bicarbonate or sodium hydroxide solution.

Even on adding small amounts of the cyclic carboxylic acid amides of the formula I, optionally with glycol compounds of the formula II, distinctly improved dyeing yields are achieved.

Compared to the fixing auxiliaries used hitherto, such as are described, for example, in German Offenlegungsschrift (German Published Specification) 1,927,639 and Swiss Patent Specification No. 569,828, the present process achieves higher dyeing yields with substantially lower amounts of auxiliaries used.

Because of the lower amounts of auxiliaries which need to be used, substantially less pollution of the waste air and waste water is achieved. In the process according to the invention, the conjoint use of additives which improve the solubility of the dyestuffs, especially of urea, and are otherwise customary, is unnecessary. This again results in a substantial reduction in the pollution of the waste air and the waste water.

The Colour Index numbers quoted in the examples relate to Volume 4 of the 3rd edition (1971).

EXAMPLE 1

A cotton cord is padded with a dyeing liquor which contains, per liter, 50 g of the dyestuff of the formula

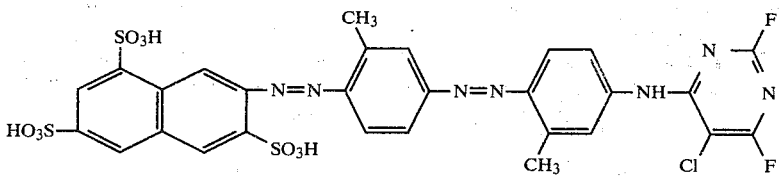

(prepared by reacting the corresponding aminodiazo dyestuff with 2,4,6-trifluoro-5-chloropyrimidine in accordance with the instructions of U.S. Pat. No. 3,669,951, Example 1), 16.5 g of caprolactam, 7.5 g of diethylene glycol monomethyl ether and 20 g of sodium bicarbonate, squeezed off to a weight pick-up of 90%, subjected to an intermediate drying and steamed for 60 seconds in saturated steam at about 102° C. The material is then rinsed, soaped and again rinsed. An orange dyeing of excellent depth of colour is obtained.

EXAMPLE 2

A cotton cord is padded with a dyeing liquor which contains, per liter, 50 g of the dyestuff of the formula

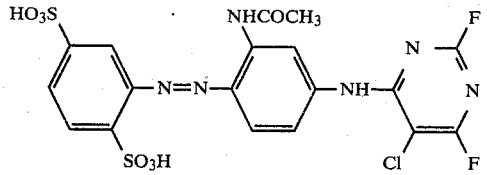

(according to U.S. Pat. No. 3,669,951, Example 176), 44 g of caprolactam, 20 g of diethylene glycol monomethyl ether and 20 g of sodium bicarbonate, squeezed off to a liquor pick-up of 90%, dried and fixed for 60 seconds with hot air at 150° C. The material is then rinsed, soaped and again rinsed. A deep yellow dyeing is obtained.

EXAMPLE 3

A mercerised cotton fabric is padded with a dyeing liquor which contains, per liter, 50 g of the dyestuff of the formula

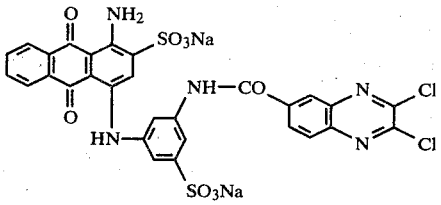

(according to U.S. Pat. No. 3,527,760, Example 258), 80 g of pyrrolidione and 20 g of sodium bicarbonate, squeezed off to 90% liquor pick-up, pre-dried at 100° C. and fixed for 1 minute by dry heat at 150° C. The material is then rinsed, soaped and again rinsed. A deep blue dyeing is obtained.

EXAMPLE 4

The procedure of Example 3 is followed, but a dyeing liquor which contains, per liter, 50 g of the dyestuff of Example 3, 80 g of N-methyl-pyrrolidone and 20 g of sodium bicarbonate is used. A deep blue dyeing is obtained.

EXAMPLE 5

The procedure of Example 3 is followed, but a dyeing liquor which contains, per liter, 50 g of the dyestuff of Example 3, 80 g of 5-methyl-oxazolidone and 20 g of sodium bicarbonate is used. A deep blue dyeing is obtained.

EXAMPLE 6

The procedure of Example 3 is followed, but a liquor which contains, per liter, 50 g of the dyestuff of Example 3, 20 g of caprolactam, 80 g of thiodiglycol and 20 g of sodium bicarbonate, is used. A blue dyeing of great depth of colour is again obtained.

EXAMPLE 7

A cotton cord is padded with a liquor which contains, per liter, 50 g of the dyestuff of the formula

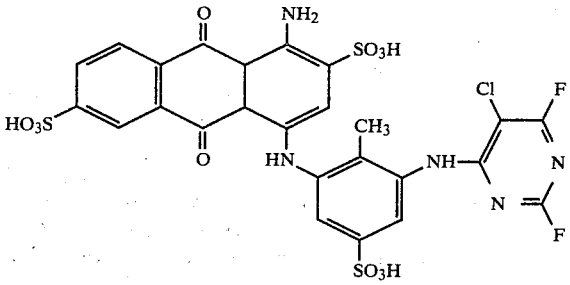

(according to U.S. Pat. No. 3,669,951, Example 397), 11 g of caprolactam, 5 g of diethylene glycol monomethyl ether and 40 g of sodium carbonate, and is squeezed off to a weight pickup of 90%. The rolled-up goods are kept for 24 hours at room temperature and are then rinsed, soaped and rinsed. An excellent blue dyeing is obtained.

EXAMPLE 8

A cotton gabardine is padded with a dyeing liquor which contains, per liter, 25 g of the direct dyestuff C.I. No. 34,200, 22 g of caprolactam and 10 g of diethylene glycol monoethyl ether, squeezed off to 80% liquor pick-up, dried and then steamed for 60 seconds at 102° C. The blue dyeing obtained is 60% deeper than without the additive according to the invention.

EXAMPLE 9

A cotton cord is padded with a liquor which contains, per liter, 25 g of the direct dyestuff C.I. No. 34,270, 44 g of caprolactam and 20 g of diethylene glycol monoethyl ether, squeezed off to a weight pick-up of 80% and then dried at 140°–150° C. without residual moisture. The material is then rinsed in the usual manner. The green dyeing obtained is 61% deeper than without the additive according to the invention.

EXAMPLE 10

A cotton cord is padded with a liquor which contains, per liter, 30 g of the direct dyestuff C.I. No. 74,180, 11 g of caprolactam, 5 g of diethylene glycol monomethyl ether and 4 g of a wetting agent, and is squeezed off to a liquor pick-up of 90%. The rolled-up goods are stored for 24 hours at room temperature and then rinsed. The blue dyeing obtained is 35% deeper than when using 150 g/l of urea.

EXAMPLE 11

A mercerised cotton fabric is padded with a dyeing liquor which contains, per liter, 30 g of the direct dyestuff C.I. No. 35,780 and 100 g of N-methylcaprolactam, squeezed off to a liquor pick-up of 80% and then dried for 2 minutes at 150°. It is then rinsed. A deep red dyeing is obtained. Comparably good results are obtained if instead of N-methylcaprolactam 100 g of N-hydroxyethyl-oxazolidone per liter or 150 g of N-methyloxazolidone per liter are used.

We claim:

1. A process for dyeing a textile material consisting entirely or partially of natural or regenerated cellulose with a direct dyestuff, said process consisting essentially of:

(a) padding the textile material with an aqueous dyeing liquor comprising a direct dyestuff, a cyclic carboxylic acid amide of the formula

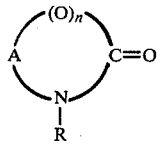

in which

R is a hydrogen atom, a $C_1$–$C_4$-alkyl radical, or a $C_1$–$C_4$-hydroxyl radical;

A is an alkylene radical required to complete a five-membered to seven-membered ring system unsubstituted or substituted by halogen, $C_1$–$C_4$-alkyl, or $C_1$–$C_4$-hydroxyalkyl and n is 0 or 1;

and a glycol compound of the formula $$R'-O-CH_2-\underset{\underset{R''}{|}}{CH}-X(CH_2-\underset{\underset{R''}{|}}{CH}-O)_n-R'''$$

in which

R′ and R‴ independently of one another are hydrogen $C_1$–$C_5$-alkyl, or acetyl;

R″ is hydrogen or methyl;

n is 0 to 2; and

X is oxygen or sulphur; and (b) fixing the dyestuff with dry heat or the action of steam whereby improved dyeing yields are obtained.

2. Process of claim 1 wherein compounds of the formula

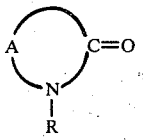

in which

R represents a hydrogen atom or a methyl radical and

A represents a straight-chain $C_3$–$C_5$-alkyl radical are used as cyclic carboxylic acid amides.

3. The process of claim 1, wherein the padded textile material is treated with superheated steam at temperatures from 102° C. to 120° C. to fix the dyestuff.

4. The process of claim 1, wherein the dyeing liquor consists essentially of a direct dyestuff; caprolactam, and diethylene glycol monomethyl ether or diethylene glycol monoethyl ether.

5. The process of claim 1, wherein the dyeing liquor further comprises a wetting agent.

6. The process of claim 1, wherein the dyestuff is fixed by dry heat at temperatures of from 95° to 200° C. for 1 to 10 minutes.

7. A process for dyeing a textile material consisting entirely or partially of natural or regenerated cellulose with a reactive dyestuff, said process consisting essentially of:

(a) padding the textile material with an aqueous dyeing liquor comprising a reactive dyestuff, a compound having an alkaline reaction for fixing the dyestuff, a cyclic carboxyclic acid amide of the formula

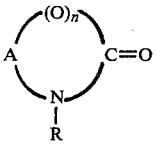

in which

R is a hydrogen atom, a $C_1$–$C_4$-alkyl radical, or a $C_1$–$C_4$-hydroxyalkyl radical;

A is an alkylene radical required to complete a five-membered to seven-membered ring system unsubstituted or substituted by halogen, $C_1$–$C_4$-alkyl, or $C_1$–$C_4$-hydroxyalkyl; and n is 0 or 1; and a glycol compound of the formula $$R'-O-CH_2-\underset{\underset{R''}{|}}{CH}-X-(CH_2-\underset{\underset{R''}{|}}{CH}-O)_n-R'''$$

in which

R′ and R‴ independently of one another are hydrogen, $C_1$–$C_5$-alkyl, or acetyl;

R″ is hydrogen or methyl;

n is 0 to 2; and

X is oxygen or sulphur; and (b) fixing the dyestuff with dry heat or the action of steam whereby improved dyeing yields are obtained.

8. The process of claim 7, wherein the padded textile material is treated with superheated steam at temperatures from 102° C. to 120° C. to fix the dyestuff.

9. The process of claim 8, wherein the padded material is dried at about 100° C. before being treated with the steam.

10. The process of claim 7, wherein the dyeing liquor consists essentially of a reactive dyestuff; caprolactam; diethylene glycol monomethyl or monoethyl ether; and sodium carbonate, sodium bicarbonate or sodium hydroxide.

11. The process of claim 7, wherein the compound having an alkaline reaction is sodium carbonate, sodium bicarbonate, or sodium hydroxide.

12. The process of claim 7, wherein the dyeing liquor further comprises a wetting agent.

13. The process of claim 7, wherein the cyclic carboxylic acid amide is a compound of the formula

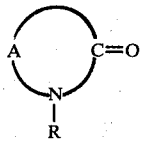

in which

R is hydrogen or methyl, and

A is a straight-chain $C_3$–$C_5$-alkyl radical.

14. The process of claim 3, wherein the padded material is dried at about 100° C. before being treated with the steam.

15. The process of claim 7, wherein the dyestuff is fixed by dry heat at temperatures of from 95° to 200° C. for 1 to 10 minutes.

* * * * *